US006446650B1

(12) United States Patent
Ma

(10) Patent No.: US 6,446,650 B1
(45) Date of Patent: Sep. 10, 2002

(54) TILT DEVICE FOR PATIO UMBRELLA

(75) Inventor: Oliver Joen-An Ma, Arcadia, CA (US)

(73) Assignee: Treasure Garden, Inc., Baldwin Park, CA (US)

( * ) Notice: Subject to any disclaimer, the term of this patent is extended or adjusted under 35 U.S.C. 154(b) by 0 days.

(21) Appl. No.: 09/735,975

(22) Filed: Dec. 13, 2000

(51) Int. Cl.[7] ..... A45B 17/00
(52) U.S. Cl. ..... 135/20.3; 135/98; 248/514
(58) Field of Search ..... 135/20.3, 20.1, 135/98; 248/514

(56) References Cited

U.S. PATENT DOCUMENTS 2,721,569 A * 10/1955 Militano
2,914,154 A 11/1959 Russell
3,129,715 A * 4/1964 Miltano et al.
3,150,671 A * 9/1964 Frey
3,926,202 A * 12/1975 Uthemann et al.
4,582,078 A * 4/1986 Ma
4,878,509 A 11/1989 Tung
5,029,596 A 7/1991 Tung
6,311,705 B1 * 11/2001 Ma

FOREIGN PATENT DOCUMENTS

DE 2259192 * 6/1974 ..... 135/20.3
IT 542146 * 4/1956 ..... 135/20.3

* cited by examiner

*Primary Examiner*—Robert Canfield
(74) *Attorney, Agent, or Firm*—Raymond Sun

(57) ABSTRACT

A tilt device for a patio umbrella has a collar that is provided for slidable movement around the exterior surface of a first pole section of the patio umbrella, and a vertical spring positioned inside the first pole section and having an upper end provided in a fixed position. The tilt device further includes a coupling leg coupled to the collar and positioned inside the first pole section, with the coupling leg having a top edge that abuts the lower end of the vertical spring. The tilt device also has a guide track positioned inside a second pole section of the patio umbrella, with a bottom edge of the coupling leg positioned inside the guide track for reciprocating movement therein.

24 Claims, 6 Drawing Sheets

TILT DEVICE FOR PATIO UMBRELLA

BACKGROUND OF THE INVENTION

1. Field of the Invention

The present invention relates to outdoor and patio umbrellas, and in particular, to a tilt device for use with outdoor and patio umbrellas.

2. Description of the Prior Art

Outdoor and patio umbrellas (hereinafter referred to collectively as patio umbrellas) have become increasingly popular in recent years as people have found new and useful applications for them. For example, patio umbrellas have traditionally been used at patios and back yards of homes to provide shade from sunlight. Patio umbrellas have also been used extensively at swimming pools and other play or recreation facilities to provide shade. Recently, hotels (and in particular, resorts) and restaurants have been major purchasers of these umbrellas.

It is often desirable to have the patio umbrella tilt at an angle in various directions. By tilting the umbrella, the user can adjust the orientation of the patio umbrella to provide more effective shading from the sunlight which may be shining from different directions during different times of the day. However, to operate effectively in tilting a patio umbrella, a tilt device should be easy to use, and should be capable of being manipulated with minimal force so that any user is able to use it (since patio umbrellas are typically very heavy and bulky).

There are currently a number of tilt devices that are available for tilting patio umbrellas. Unfortunately, many of the tilt devices suffer from a number of drawbacks, including but not limited to the following. First, some of these known tilt devices have a complex construction which renders them expensive to manufacture and raises questions as to their reliability. Second, some of these known tilt devices, when incorporated with a patio umbrella, may compromise the stability and strength of the overall patio umbrella. Third, some of these known tilt devices require complicated steps or procedures for deployment. Fourth, many of these tilt devices still require the user to exert much force to operate the tilt device. Fifth, the many moving parts that are usually integrated to provide a tilt device often compromises the durability of the tilt device.

Thus, there remains a need to provide a tilt device for use in tilting a patio umbrella that is easy to operate, is safe and stable, is simple in construction, and provides increased durability.

SUMMARY OF THE DISCLOSURE

It is an object of the present invention to provide a tilt device for a patio umbrella that is easy to use.

It is another object of the present invention to provide a tilt device for a patio umbrella that can be operated using minimal force.

It is yet another object of the present invention to provide a tilt device for a patio umbrella that does not compromise the stability of the patio umbrella.

It is yet a further object of the present invention to provide a tilt device for a patio umbrella that is simple in construction yet provides increased durability.

The objectives of the present invention are accomplished by providing a tilt device for a patio umbrella, the patio umbrella having a pole having a first pole section and a second pole section. The tilt device has a collar that is provided for slidable movement around the exterior surface of the first pole section, and a vertical spring positioned inside the first pole section and having an upper end provided in a fixed position. The tilt device further includes a coupling leg coupled to the collar and positioned inside the first pole section, with the coupling leg having a top edge that abuts the lower end of the vertical spring. The tilt device also has a guide track positioned inside the second pole section, with a bottom edge of the coupling leg positioned inside the guide track for reciprocating movement therein.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
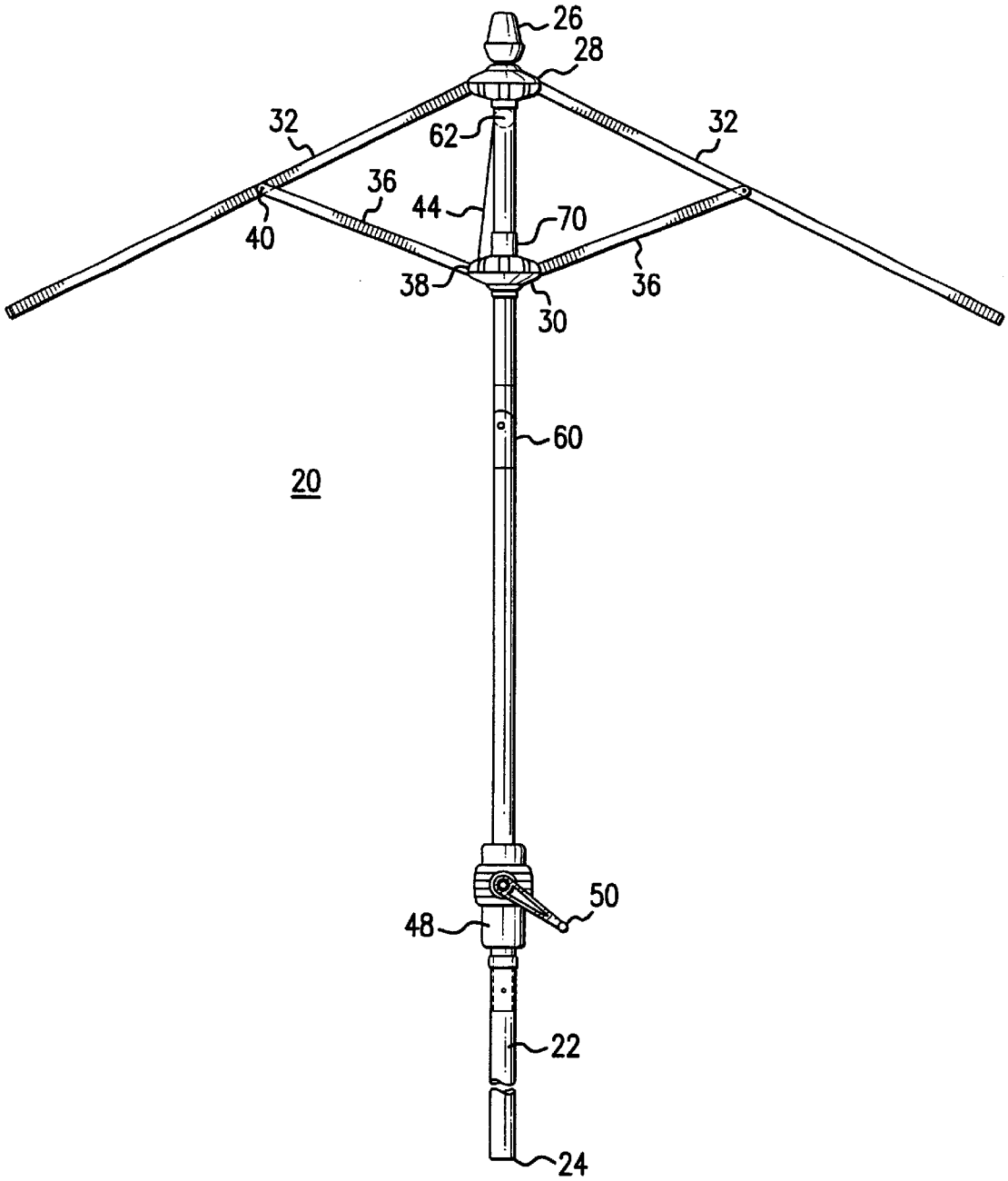
FIG. 1 is a side view of a portion of a patio umbrella according to one embodiment the present invention.
Figure 4:
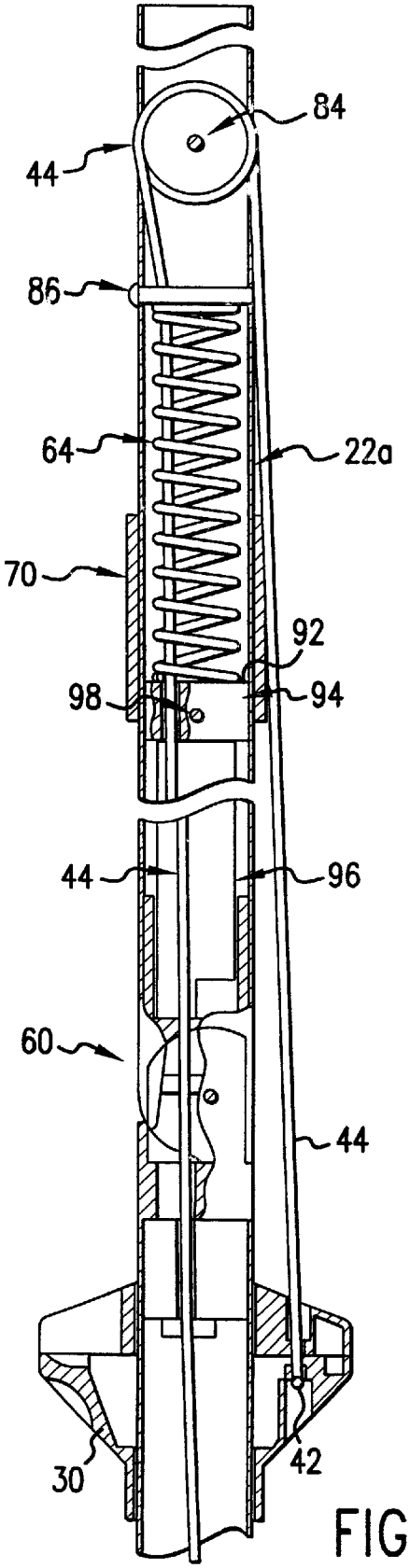
FIG. 4 is a cross-sectional side view illustrating the tilt device of FIG. 3 in the non-tilt position.

FIG. 1 illustrates the skeletal frame for a patio umbrella 20 according to the present invention. The umbrella 20 has a pole 22 having a lower end 24 that is adapted to be inserted into the bore of a conventional umbrella base (not shown). A hub and runner system is provided adjacent the top of the pole 22, where is finial 26 is provided. The hub and runner system includes an upper hub 28 that is permanently fixed or secured to the top of the pole 22, a lower hub or runner 30 that is adapted to slide along a portion of the vertical length of the pole 22 below the upper hub 28, and a pulley system that cooperatively couples the upper hub 28 and the lower hub 30. The terms "lower hub" and "runner" will be used interchangeably throughout this disclosure, and are intended to describe the same element. The upper hub 28 can have the same construction as any conventional upper hub, while the lower hub 30 and pulley system will be described in greater detail below. In addition, the umbrella 20 includes a plurality of long ribs 32 extending radially from the upper hub 28 for supporting the umbrella covering 46 (see FIG. 2). The umbrella 20 also has a plurality of short ribs 36, each short rib 36 having an inner end 38 pivotally connected to and extending radially from the lower hub 30, and an outer end 40 that is pivotally connected to a corresponding long rib 32 at a location between the opposing ends of the long rib 32. The connections of the ribs 32 and 36 to each other, and to the hubs 28 and 30, can be accomplished in accordance with any of the constructions that are known in the art, and shall not be described in greater detail herein. In addition, as shown in FIG. 4, one end 42 of the pulley rope 44 is secured (e.g., in a knotted connection) inside the lower hub 30 in accordance with any of the constructions that are known in the art.

In addition, the patio umbrella 20 has a winch 48 with a crank handle 50. One end of the pulley rope 44 (i.e., the end opposite the end 42) is wound around a shaft coupled to the crank handle 50 in a manner that is well-known in the art. The crank handle 50 is wound or turned to operate the pulley system to open and close the patio umbrella 20, and in the present invention, to also tilt and un-tilt the covering 46 of the patio umbrella 20.

Figure 2:
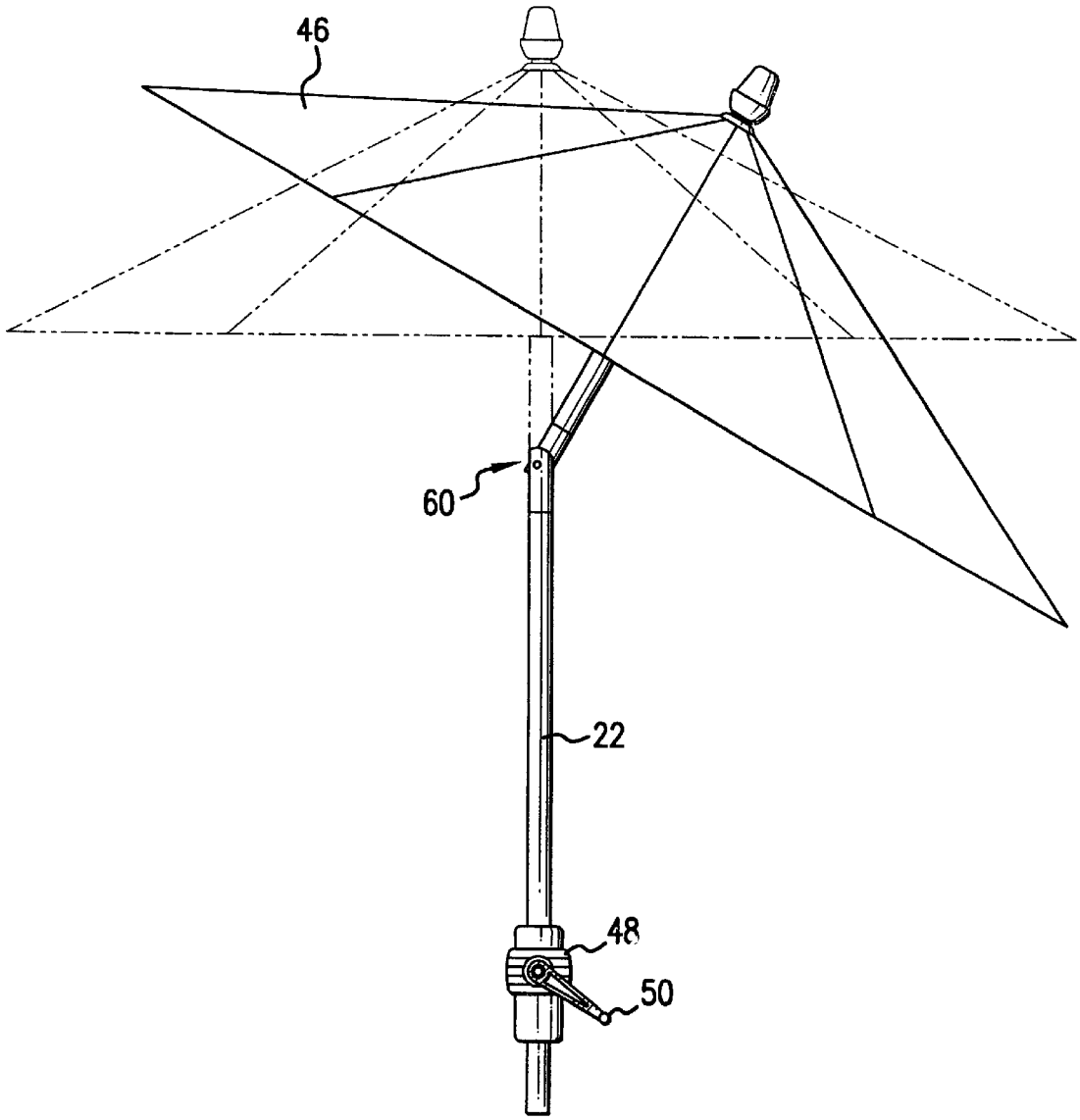
FIG. 2 is a side view of the patio umbrella of FIG. 1 showing how the patio umbrella tilts.

As best illustrated in FIG. 2, the tilt device of the present invention tilts the pole 22 of the patio umbrella 20 about a pivot joint 60. This pivot joint 60 is a part of the tilt device of the present invention, and is illustrated in greater detail in FIGS. 3–7.

The tilt device of the present invention is best illustrated in FIGS. 3–7. The pole 22 is actually divided into two sections, an upper pole section 22*a* and a lower pole section 22*b* that are divided at the pivot joint 60. The upper pole section 22*a* houses a pulley wheel 62, a vertical spring 64, a coupling leg 66, and a recoil spring 68. In addition, an outer collar 70 extends around the outer surface 72 of the upper pole section 22*a*, and is coupled to the coupling leg 66. The lower pole section 22*b* has a U-shaped frame 74 adjacent its upper end 76, and provides a guide track 78 adjacent and slightly below the U-shaped frame 74. These components of the tilt device cooperate with the lower hub 30 to tilt the covering 46 of the patio umbrella 20.

Figure 3:
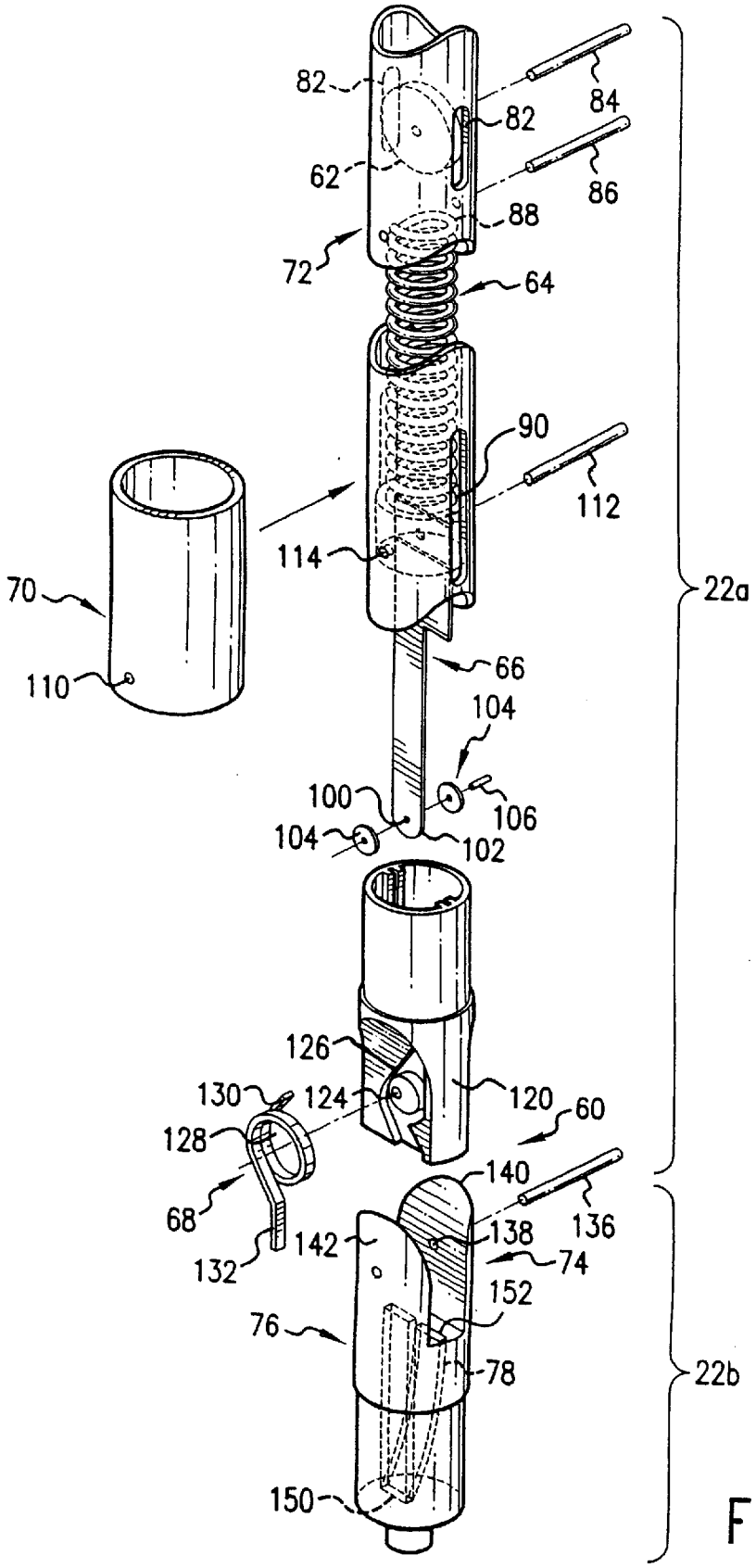
FIG. 3 is an exploded perspective view of the tilt device of the patio umbrella, and portions of the patio umbrella, of FIG. 1.
Figure 7:
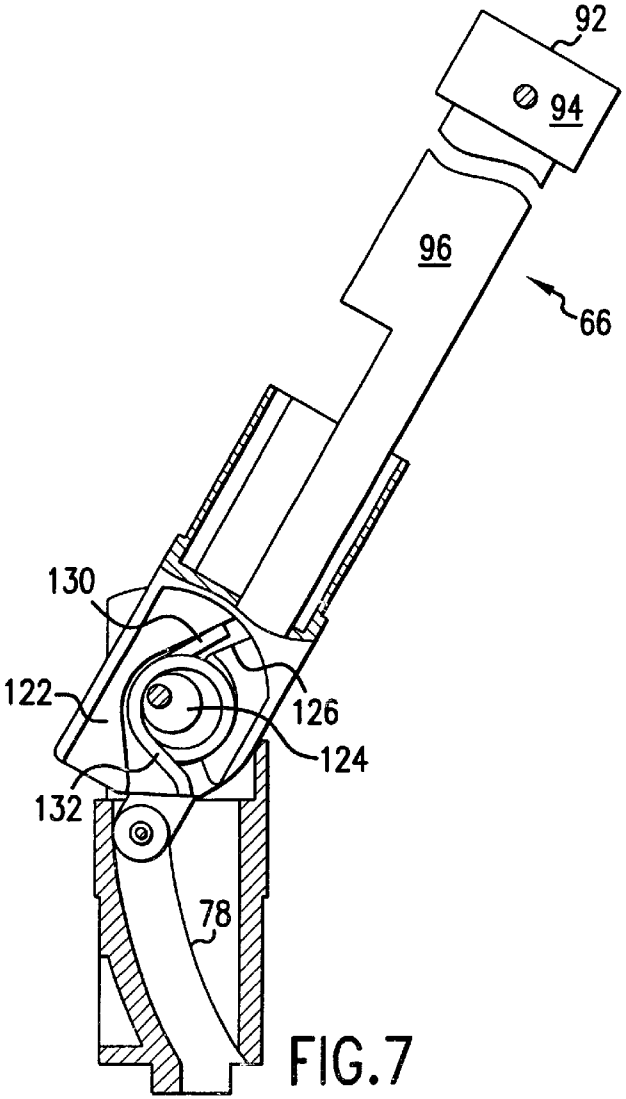
FIG. 7 is a cross-sectional side view illustrating the pivot joint of the tilt device of FIG. 3 in the tilt position.
Figure 6:
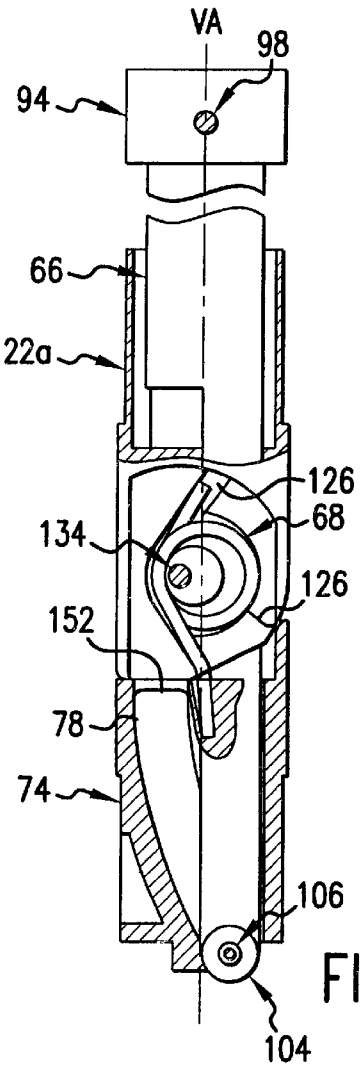
FIG. 6 is a cross-sectional side view illustrating the pivot joint of the tilt device of FIG. 3 in the non-tilt position.

Referring first to the upper pole section 22*a*, the pulley wheel 62 is positioned for rotation adjacent but offset from the upper hub 28. A pair of opposing slots 82 are provided in the wall of the upper pole section 22*a* for allowing the pulley wheel 62 to rotate therethrough, so that pulley rope 44 can pass through the interior of the upper pole section 22*a* to be carried by the pulley wheel 62. The pulley wheel 62 is carried on a shaft 84 for rotation at its location in the upper pole section 22*a*. Positioned slightly below the pulley wheel 62 is a pin or bar 86 that is provided to extend across the hollow interior of the upper pole section 22*a* at a fixed location thereat. This bar 86 defines the upper limit or stop for the upper end 88 of the vertical spring 64, which is positioned in a non-fixed manner inside the hollow interior of the upper pole section 22*a*. In other words, the vertical spring 64 can reciprocate up and down inside the upper pole section 22*a*. The lower end 90 of the vertical spring 64 abuts the top edge 92 of the coupling leg 66 (see FIG. 4). As best shown in FIGS. 3, 6 and 7, the coupling leg 66 has a top plate 94 having the top edge 92, and an L-shaped leg section 96 that extends below the top plate 94. A top opening 98 is provided in the top plate 94, and a bottom opening 100 is provided near the bottom edge 102 of the leg section 96. One roller 104 is provided on each side of the leg section 96 adjacent the bottom edge 102, and are rotatably secured to the leg section 96 via a shaft 106 that extends through the rollers 104 and the bottom opening 100.

The collar 70 extends around the outer surface 72 of the upper pole section 22*a* adjacent the location of the top plate 94 of the coupling leg 66. Aligned openings 110 are provided in opposing walls of the collar 70, and a pin or shaft 112 is inserted through the aligned openings 110, another pair of aligned openings 114 in the upper pole section 22*a*, and the top opening 98 in the top plate 94. Thus, the collar 70 that travels along the outer surface 72 of the upper section 22*a* is coupled to the coupling leg 66 in a manner so that upward movement of the collar 70 will cause the coupling leg 66 to move up, and downward movement of the collar 70 will cause the coupling leg 66 to move down.

Referring to FIGS. 3, 6 and 7, the lower end 120 of the upper pole section 22*a* has a narrowed section that has a narrowed thickness to allow it to be inserted into the U-shaped frame 74 of the lower pole piece 22*b*. On one side 122 of the narrowed section 120 is provided a protrusion 124 and a curved track 126 that extends around a portion of the protrusion 124. The recoil spring 68 is provided by coiling a metal wire to form a generally circular center 128, a short upper strip 130 that extends at an angle from the circular center 128, and a slightly longer lower strip 132 that extends generally vertically from the circular center 128. The recoil spring 68 is fitted into the curved track 126 by fitting the protrusion 124 into the circular center 128, and then the upper strip 130 and the lower strip 132 are fitted into the curved track 126. The recoil spring 68 is therefore retained between the narrowed section 120 and the U-shaped frame 74 of the lower pole section 22*b*. An opening 134 (see FIG. 6) extends through the narrowed section 120 and the protrusion 124, and is adapted to receive a pivot pin or shaft 136 that also extends through aligned openings 138 in the opposing arms 140 and 142 of the U-shaped frame 74. Thus, the pivot joint 60 is formed by the narrowed section 120, the recoil spring 68, the U-shaped frame 74 and the pivot pin 136.

The lower pole section 22*b* includes the U-shaped frame 74 and the guide track 78 that is positioned adjacent and slightly below the U-shaped frame 74. As best shown in FIGS. 3, 6 and 7, the guide track 78 has a lower end 150 that is positioned at about the center (i.e., the vertical axis VA) of the lower pole section 22*b*, and perhaps slightly closer to one side wall. The guide track 78 then extends in a curved manner from the lower end 150 to an upper end 152 that is positioned offset from the center towards an opposing side wall of the lower pole section 22*b*. As explained in greater detail below, the guide track 78 is adapted to receive the rollers 104 and it is the curved nature of the track 78 that facilitates the tilting of the upper pole section 22*a* about the pivot joint 60. Thus, the rollers 104 (and the portion of the coupling leg 66 which carries the rollers 104) are actually retained inside the lower pole section 22*b*.

Figure 5:
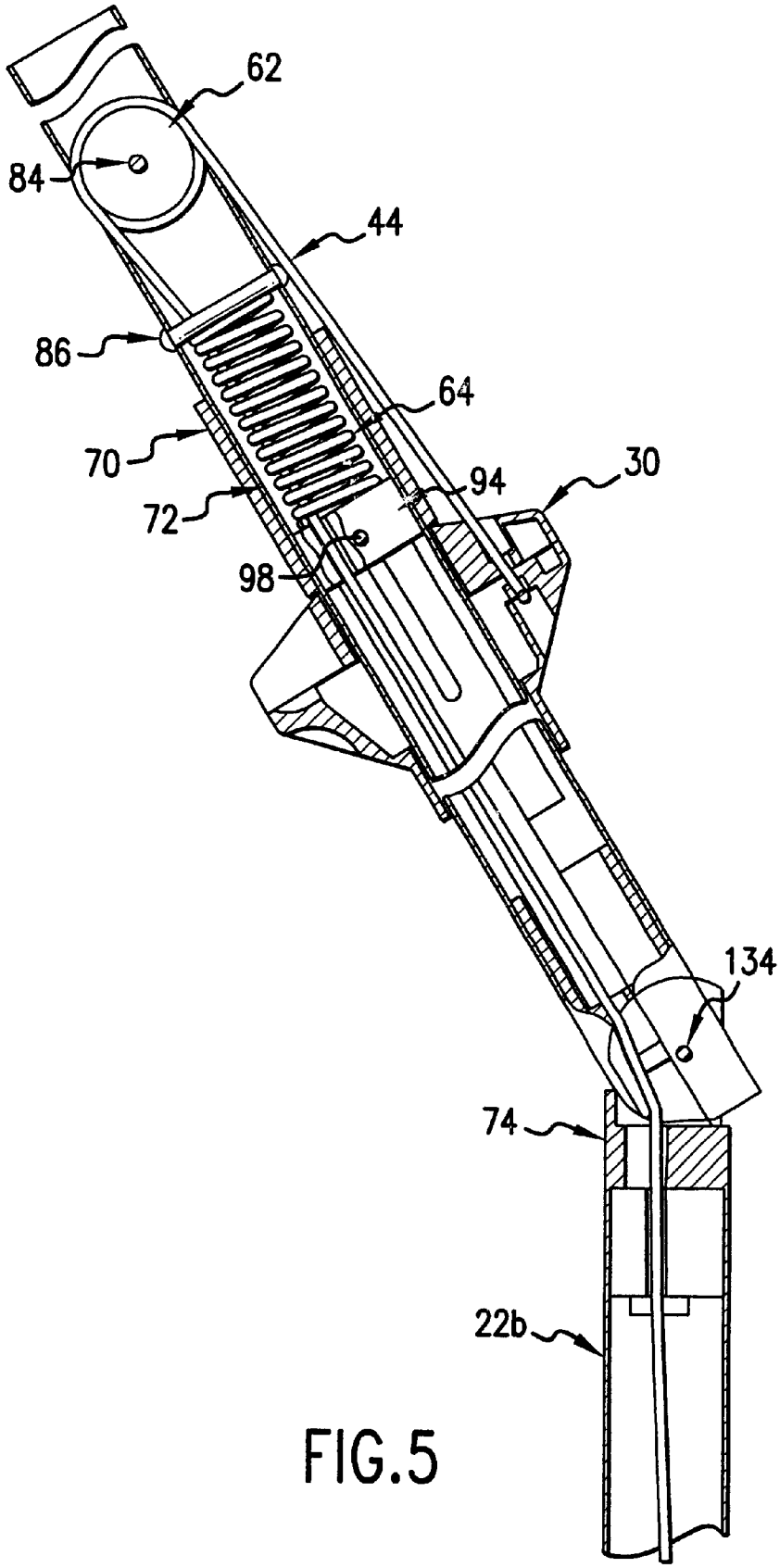
FIG. 5 is a cross-sectional side view illustrating the tilt device of FIG. 3 in the tilt position.

Referring to FIGS. 4 and 5, the pulley rope 44 extends from the crank handle 50 upwardly through the lower pole section 22*b* and the upper pole section 22*a* until it reaches the pulley wheel 62, where it is carried around the pulley wheel 62 to one of the open slots 82 where the pulley rope 44 exits the upper pole section 22*a*. The pulley rope 44 then extends downwardly along upper pole section 22*a* to the lower hub 30 where its end 42 is secured to the lower hub 30 using known techniques.

The operation of the tilt device is best illustrated in FIGS. 4–7. First, the patio umbrella 20 is opened by rotating or winding the crank handle 50 which winds the pulley rope 44 about the pulley wheel 62, thereby raising the lower hub 30 along the pole 22. If it is desired to maintain the patio umbrella 20 in an open position without any tilt, the lower hub 30 would be either spaced apart from, or adjacent, the collar 70 along the upper pole section 22*a*. In this position, the position of the collar 70 along the upper pole section 22*a* would not have been changed. FIGS. 4 and 6 illustrate the relative positions and orientations of the lower hub 30, the collar 70, the vertical spring 64, and the coupling leg 66 when the patio umbrella 20 in an open position without any tilt. The vertical spring 64 is unbiased and stretches along its greatest length inside the upper pole section 22*a*. The coupling leg 66 is in its lowermost vertical position inside the pole 22, with the rollers 104 positioned adjacent the lower end 150 of the guide track 78. The recoil spring 68 is in its unbiased position fitted inside the curved track 126.

If the user desires to tilt the patio umbrella 20 when it is in an open position, the user would continue to wind or rotate the crank handle 50, further raising the lower hub 30 along the upper pole section 22*a* until the lower hub 30 abuts the collar 70 along the outer surface 72. By further rotating the crank handle 50, the lower-hub 30 will push the collar 70 upwardly along the outer surface 72 of the upper pole section 22*a*. As the collar 70 moves upwardly, it pulls the coupling leg 66 upwardly along with it. As the coupling leg 66 moves upwardly inside the upper pole section 22*a*, the top plate 94 of the coupling leg 66 will compress or bias the vertical spring 64, and the rollers 104 will roll or move upwardly along the curved guide track 78. The curved and offset nature of the guide track 78 (i.e., away from the center of the pole 22) will tilt the coupling leg 66 at an angle with respect to the vertical axis VA (see FIG. 7) as the rollers 104 travel upwardly along the guide track 78. As the coupling leg 66 tilts at an angle, it forces the upper pole section 22*a* to be tilted at about the same angle about the pivot pin 136, and further biases or compresses the recoil spring 68 (see FIG. 7, and compare with FIG. 6). The narrowed section 120 pivots between the arms 140, 142 of the U-shaped frame 74. The degree of the tilt will depend on where the rollers 104 are finally positioned in the guide track 78. For example, the greatest degree of tilt is obtained when the rollers 104 are adjacent the upper end 152 of the guide track 78.

If the user now decides to straighten (i.e., un-tilt) the patio umbrella 20 to its original upright or vertical open position, the user merely turns the crank handle 50 in the opposite direction. This gradually releases portions of the pulley rope 44, so that gravity and the weight of the lower hub 30 will gradually lower the lower hub 30 along the upper pole section 22*a*. As the lower hub 30 travels down the upper pole section 22*a*, it releases its contact or abutment with the collar 70. The bias that has been built up in the vertical spring 64 and the recoil spring 68 will operate to un-tilt the upper pole section 22*a*. Specifically, the bias of the vertical spring 64 will push the coupling leg 66 downward, causing the rollers 104 to travel back down the guide track 78. If the size and weight of the patio umbrella 20 were sufficiently small, then the bias of the vertical spring 64 and the configuration of the guide track 78 should be sufficient to completely un-tilt the upper pole section 22*a*. However, to provide more effective un-tilting of the upper pole section 22*a* , the recoil spring 68 has been provided to utilize the bias of the recoil spring 68 (as shown in FIG. 7) to aid the upper pole section 22*a* to pivot back to its original upright position. When the coupling leg 66 has been biased to the point where the rollers 104 have traveled to the lower end 150 of the guide track 78, the upper pole section 22*a* will be completely un-tilted as shown in FIGS. 4 and 6.

Thus, the tilt device of the present invention is simple in construction and uses a minimal number of parts because its primary components include only the coupling leg 66 and the guide track 68. The simple construction and minimal number of parts also increase the durability and ease of use of the tilt device. The use of the rollers 104 to travel along the guide track 78, and the provision of the vertical spring 64 and the recoil spring 68, mean that less force is required by the user to tilt and un-tilt the patio umbrella 20. The fact that the coupling leg 66 is coupled to both the collar 70 and the lower pole section 22*b* (via the rollers 104) further enhance the stability of the patio umbrella 20.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A tilt device for a patio umbrella, the patio umbrella having a pole having a first pole section that can be tilted with respect to a second pole section, the first pole section having an exterior surface, the tilt device comprising:

a collar adapted for slidable movement around the exterior surface of the first pole section;

a vertical spring adapted to be positioned inside the first pole section and having a lower end, and an upper end provided in a fixed position;

a coupling leg coupled to the collar and adapted to be positioned inside the first pole section, the coupling leg having a top edge that abuts the lower end of the vertical spring, and further including a bottom edge; and a guide track adapted to be positioned inside the second pole section, with the bottom edge of the coupling leg positioned inside the guide track for reciprocating movement therein;

wherein the reciprocating movement of the coupling leg inside the guide track tilts the first pole section with respect to the second pole section.

2. The tilt device of claim 1, wherein the guide track has an upper end and a lower end, and wherein the bottom edge of the coupling leg is positioned in the lower end of the guide track when the first and second pole sections are vertically aligned.

3. The tilt device of claim 1, wherein the guide track has an upper end and a lower end, and wherein the bottom edge of the coupling leg is positioned in the upper end of the guide track when the first pole section is tilted at an angle from the second pole section.

4. The tilt device of claim 1, wherein the coupling leg includes a roller that is rotatably coupled to the bottom edge of the coupling edge, with the roller positioned inside the guide track for reciprocating movement therein.

5. The tilt device of claim 1, further including a pivot joint that is adapted to couple the first and second pole sections, with the pivot joint including the coupling leg and the guide track.

6. The tilt device of claim 5, further including a recoil spring adapted to be positioned between the first and second pole sections at the pivot joint.

7. The tilt device of claim 1, further including a pin that is adapted to extend through the collar, the first pole section and the coupling leg to couple the coupling leg to the collar.

8. The tilt device of claim 1, further including a stop member positioned above the upper end of the vertical spring to define the fixed position.

9. The tilt device of claim 5, wherein the pivot joint further includes a pivot pin that is adapted to extend through the first and second pole sections.

10. The tilt device of claim 1, wherein the guide track is a single guide track.

11. A patio umbrella comprising:

a pole having a first pole section and a second pole section, the first pole section having an exterior surface; and a tilt device composing:

a collar provided for slidable movement around the exterior surface of the first pole section;

a vertical spring positioned inside the first pole section and having a lower end, and an upper end provided in a fixed position;

a coupling leg coupled to the collar and positioned inside the first pole section, the coupling leg having a top edge that abuts the lower end of the vertical spring, and further including a bottom edge; and a guide track positioned inside the second pole section, with the bottom edge of the coupling leg positioned inside the guide track for reciprocating movement therein;

wherein the reciprocating movement of the coupling leg inside the guide track tilts the first pole section with respect to the second pole section.

12. The umbrella of claim 11, wherein the guide track has an upper end and a lower end, and wherein the bottom edge of the coupling leg is positioned in the lower end of the guide track when the first and second pole sections are vertically aligned.

13. The umbrella of claim 11, wherein the guide track has an upper end and a lower end, and wherein the bottom edge of the coupling leg is positioned in the upper end of the guide track when the first pole section is tilted at an angle from the second pole section.

14. The umbrella of claim 11, wherein the coupling leg includes a roller that is rotatably coupled to the bottom edge of the coupling edge, with the roller positioned inside the guide track for reciprocating movement therein.

15. The umbrella of claim 11, further including a pivot joint that couples the first and second pole sections, with the pivot joint including the coupling leg and the guide track.

16. The umbrella of claim 15, further including a recoil spring positioned between the first and second pole sections at the pivot joint.

17. The umbrella of claim 11, wherein the guide track has an upper end and a lower end, with the lower end positioned at about the vertical center of the second pole section, and the upper end positioned away from the vertical center towards a side of the second pole section.

18. The umbrella of claim 16, wherein the first pole section has a narrowed lower end, and the second pole section has an upper end with a U-shaped frame provided thereat, wherein the recoil spring is positioned inside the U-shaped frame and outside the narrowed lower end.

19. The umbrella claim 18, wherein the narrowed lower end has an outer surface with a curved track provided thereon for receiving the recoil spring.

20. The umbrella of claim 11, wherein the first pole section is an upper pole section, and the second pole section is a lower pole section.

21. A method for tilting a patio umbrella that has a pole having a first pole section, a second pole section, and a lower hub positioned along the pole, with the first pole section having an exterior surface, comprising:

(a) providing a tilt device having:

a collar positioned around the exterior surface of the first pole section;

a vertical spring positioned inside the first pole section and having a lower end, and an upper end provided in a fixed position;

a coupling leg coupled to the collar and positioned inside the first pole section, the coupling leg having a top edge that abuts the lower end of the vertical spring, and further including a bottom edge; and a guide track positioned inside the second pole section, with the bottom edge of the coupling leg positioned inside the guide track for reciprocating movement therein;

(b) raising the lower hub along the pole until the lower hub abuts the collar; and (c) further raising the lower hub along the pole to push the collar upwardly along the pole, thereby causing the coupling leg to be raised upwardly, and the bottom edge of the coupling leg to be moved upwardly along the guide track, to tilt the first pole section with respect to the second pole section.

22. The method of claim 21, wherein further raising the lower hub along the pole to push the collar upwardly along the pole also compresses the vertical spring.

23. The method of claim 21, further including:

untilting the first pole section by lowering the lower hub, so that the vertical spring biases the coupling leg downwardly and causes the bottom edge of the coupling leg to be moved upwardly along the guide track.

24. The method of claim 23, further including:

providing a recoil spring adjacent the coupling leg to bias the coupling leg to a vertical orientation.

* * * * *